US009583251B2

(12) United States Patent
Moon et al.

(10) Patent No.: US 9,583,251 B2
(45) Date of Patent: Feb. 28, 2017

(54) CHIP ELECTRONIC COMPONENT AND BOARD HAVING THE SAME

(71) Applicant: SAMSUNG ELECTRO-MECHANICS CO., LTD., Suwon-si, Gyeonggi-do (KR)

(72) Inventors: Je Ik Moon, Suwon-si (KR); Sung Soo Kim, Suwon-si (KR); Tae Young Kim, Suwon-si (KR); Ye Eun Jeong, Suwon-si (KR); Jong Hun Kim, Suwon-si (KR); Seong Min Chin, Suwon-si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 0 days.

(21) Appl. No.: 14/686,651

(22) Filed: Apr. 14, 2015

(65) Prior Publication Data

US 2016/0086714 A1 Mar. 24, 2016

(30) Foreign Application Priority Data

Sep. 22, 2014 (KR) ..... 10-2014-0126206

(51) Int. Cl.

| | |
|---|---|
| ***H01F 5/00*** | (2006.01) |
| ***H01F 27/24*** | (2006.01) |
| ***H01F 27/29*** | (2006.01) |
| ***H01F 27/255*** | (2006.01) |
| ***H01F 27/28*** | (2006.01) |

(Continued)

(52) U.S. Cl.

CPC ..... *H01F 27/255* (2013.01); *H01F 17/0013* (2013.01); *H01F 27/2804* (2013.01); *H01F 27/292* (2013.01); *H01F 2017/048* (2013.01); *H01F 2027/2809* (2013.01)

(58) Field of Classification Search

CPC .... H01F 27/255; H01F 27/2804; H01F 27/33; H01F 27/29; H01F 27/292; H01F 2027/2809; H01F 5/003; H01F 17/0006; H01F 17/0013; H01F 3/08

USPC ..... 336/200, 233, 192

See application file for complete search history.

(56) References Cited

U.S. PATENT DOCUMENTS 6,218,925 B1 * 4/2001 Iwao ..... H01F 17/0013 336/200
6,373,368 B1 * 4/2002 Shikama ..... H01F 41/04 29/605

(Continued)

FOREIGN PATENT DOCUMENTS

JP 2006-278909 A 10/2006
JP 2008-166455 A 7/2008

(Continued)

*Primary Examiner* — Mangtin Lian

(74) *Attorney, Agent, or Firm* — McDermott Will & Emery LLP

(57) ABSTRACT

There is provided a chip electronic component including: a magnetic body containing magnetic metal powder particles and a thermosetting resin; an internal coil part embedded in the magnetic body; and a surface protection layer with which a surface of the magnetic body is coated. The surface protection layer may prevent a plating spreading phenomenon occurring on a surface of the chip electronic component at the time of forming external electrodes.

16 Claims, 5 Drawing Sheets

(51) Int. Cl.
*H01F 17/00* (2006.01)
*H01F 17/04* (2006.01)

(56) References Cited

U.S. PATENT DOCUMENTS

| | | | | |
|---|---|---|---|---|
| 2010/0289607 | A1* | 11/2010 | Liu | H01F 3/14 336/65 |
| 2013/0076203 | A1* | 3/2013 | Saito | H01G 4/12 310/311 |
| 2013/0113593 | A1* | 5/2013 | Jeong | H01F 17/0013 336/200 |
| 2013/0222101 | A1 | 8/2013 | Ito et al. | |
| 2013/0293334 | A1* | 11/2013 | Shin | H01F 1/26 336/192 |
| 2015/0115776 | A1* | 4/2015 | Terashita | H01C 7/008 310/365 |
| 2015/0162124 | A1* | 6/2015 | Kim | H01F 17/0013 336/200 |

FOREIGN PATENT DOCUMENTS

| | | | |
|---|---|---|---|
| JP | 2013-254917 | A | 12/2013 |
| KR | 10-2007-0100491 | A | 10/2007 |
| KR | 10-2011-0114238 | A | 10/2011 |
| KR | 10-1194785 | B1 | 10/2012 |
| KR | 10-2013-0049207 | A | 5/2013 |
| KR | 10-2013-0049875 | A | 5/2013 |

* cited by examiner

CHIP ELECTRONIC COMPONENT AND BOARD HAVING THE SAME

CROSS-REFERENCE TO RELATED APPLICATION

This application claims the priority and benefit of Korean Patent Application No. 10-2014-0126206 filed on Sep. 22, 2014, with the Korean Intellectual Property Office, the disclosure of which is incorporated herein by reference.

BACKGROUND

The present disclosure relates to a chip electronic component and a board having the same.

An inductor, one of chip electronic components, is a representative passive element configuring an electronic circuit together with a resistor and a capacitor to remove noise.

A thin film type inductor is manufactured by forming internal coil parts by plating and then hardening a magnetic powder-resin composite in which magnetic powder particles and a resin are mixed with each other to form a magnetic body and forming external electrodes on outer surfaces of the magnetic body.

RELATED ART DOCUMENT (Patent Document 1) Japanese Patent Laid-Open Publication No. 2008-166455

SUMMARY

An aspect of the present disclosure may provide a chip electronic component capable of preventing a plating spreading phenomenon occurring on surfaces thereof at the time of forming external electrodes.

According to an aspect of the present disclosure, a chip electronic component may include: a magnetic body containing magnetic metal powder particles; internal coil parts embedded in the magnetic body; and surface protection layers formed on surfaces of the magnetic body to serve as plating spreading prevention layers.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Figure 1:
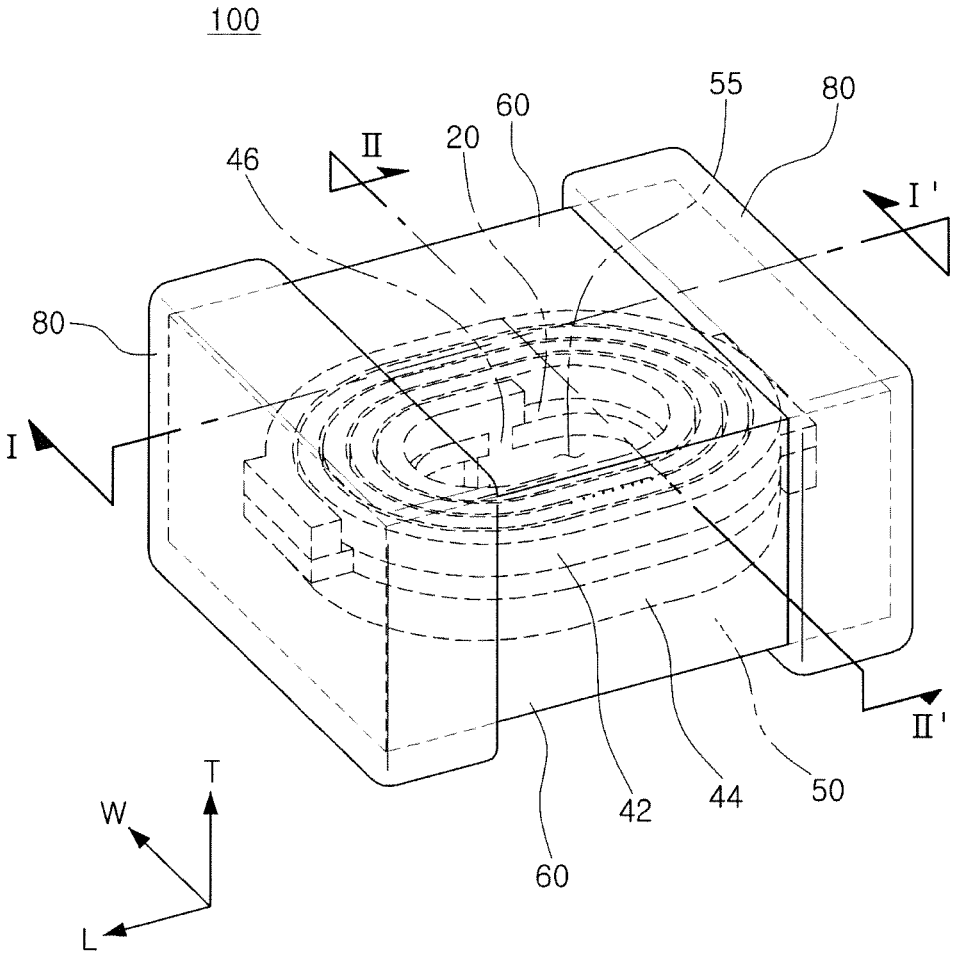
FIG. 1 is a schematic perspective view of a chip electronic component including internal coil parts according to an exemplary embodiment of the present disclosure.

Exemplary embodiments of the present disclosure will now be described in detail with reference to the accompanying drawings.

The disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

Chip Electronic Component

Hereinafter, a chip electronic component according to an exemplary embodiment of the present disclosure, particularly, a thin film type inductor will be described. However, the present disclosure is not necessarily limited thereto.

FIG. 1 is a schematic perspective view of a chip electronic component including internal coil parts according to an exemplary embodiment of the present disclosure.

Referring to FIG. 1, a thin film type inductor 100 used in a power line of a power supply circuit is disclosed as an example of the chip electronic component.

The chip electronic component 100 according to an exemplary embodiment of the present disclosure may include a magnetic body 50, internal coil parts 42 and 44 embedded in the magnetic body 50, and surface protection layers 60 with which surfaces of the magnetic body 50 are coated, and external electrodes 80 disposed on outer surfaces of the magnetic body 50 and electrically connected to the internal coil parts 42 and 44.

In the chip electronic component 100 according to an exemplary embodiment of the present disclosure, a 'length' direction refers to an 'L' direction of FIG. 1, a 'width' direction refers to a 'W' direction of FIG. 1, and a 'thickness' direction refers to a 'T' direction of FIG. 1.

Figure 2:
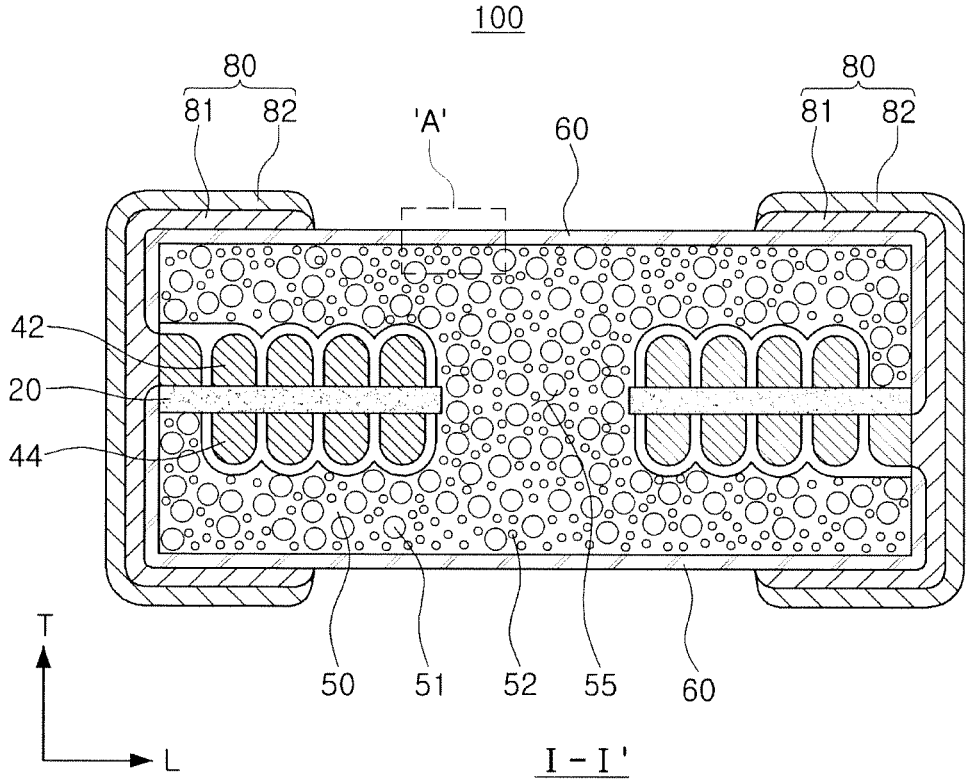
FIG. 2 is a cross-sectional view taken along line I-I' of FIG. 1.
Figure 3:
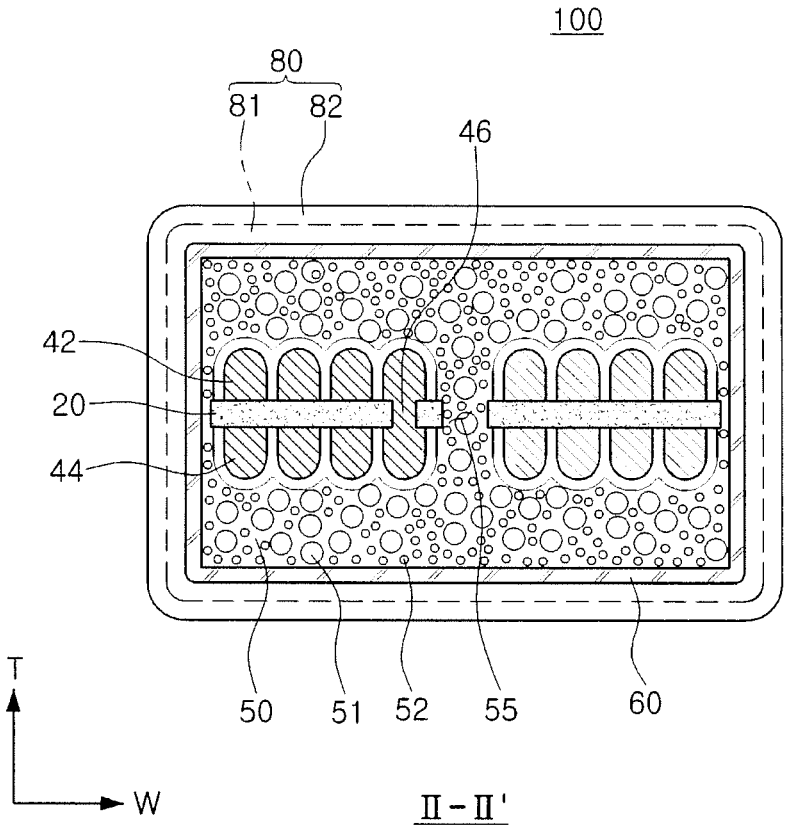
FIG. 3 is a cross-sectional view taken along line II-II' of FIG. 1.

FIG. 2 is a cross-sectional view taken along line I-I' of FIG. 1; and FIG. 3 is a cross-sectional view taken along line II-II' of FIG. 1.

Referring to FIGS. 2 and 3, the magnetic body 50 may contain magnetic metal powder particles 51 and 52.

The magnetic metal powder particles 51 and 52 may contain one or more selected from the group consisting of Fe, Si, Cr, Al, and Ni. For example, the magnetic metal powder particles may be a Fe—Si—B—Cr based amorphous metal, but are not necessarily limited thereto.

The magnetic body 50 may further contain a thermosetting resin, and the magnetic metal powder particles 51 and 52 may be contained in the thermosetting resin such as an epoxy resin, a polyimide resin, or the like, in a form in which they are dispersed in the thermosetting resin.

In order to improve a packing factor of the magnetic metal powder particles contained in the magnetic body 50, two or more kinds of magnetic metal powder particles 51 and 52 having different particle sizes may be mixed with each other in a predetermined ratio.

Magnetic metal powder particles having a large particle size and a high magnetic permeability are used in order to obtain a high inductance in a defined unit volume, and magnetic metal powder particles having a small particle size are mixed with the magnetic metal powder particles having the large particle size to improve a packing factor, whereby a high magnetic permeability may be secured and an efficiency decrease due to core loss at a high frequency and a high current may be prevented.

However, in the case in which the magnetic metal powder particles having the large particle size and the magnetic metal powder particles having the small particle size are mixed with each other as described above, a surface roughness of the magnetic body may become large. Particularly, the magnetic metal powder particles having the large particle size may protrude on a surface of the magnetic body in a process of polishing the magnetic body cut at an individual chip size, and an insulating coating layer at a protrusion portion may be peeled off.

Therefore, at the time of forming plating layers of the external electrodes, a plating spreading defect that the plating layers are formed on the magnetic metal powder particles at which the insulating coating layer is peeled off may occur.

Therefore, in an exemplary embodiment of the present disclosure, the surface protection layers 60 may be formed on the surfaces of the magnetic body 50 to solve the above-mentioned problem. The surface protection layer 60 may cover the magnetic metal powder particles protruding on the surface of the magnetic body to serve as a plating spreading prevention layer.

The surface protection layer and the plating spreading prevention layer may be the same component. Therefore, hereinafter, only the surface protection layer will be described.

The surface protection layer 60 may contain a thermosetting resin the same as the thermosetting resin contained in the magnetic body 50.

For example, the magnetic body 50 may have a form in which the magnetic metal powder particles 51 and 52 are dispersed in the epoxy resin, and the surface protection layer 60 may contain the epoxy resin.

The surface protection layer 60 may be formed of the thermosetting resin the same as the thermosetting resin contained in the magnetic body 50, such that adhesion of the surface protection layer 60 may be improved. Therefore, damages to the surface protection layer 60 due to external impact at the time performing grinding in a post-process may be prevented.

A detailed description for the surface protection layer 60 according to an exemplary embodiment of the present disclosure will be provided below.

The magnetic body 50 according to an exemplary embodiment of the present disclosure may contain mixtures of first magnetic metal powder particles 51 and second magnetic metal powder particles 52 having $D_{50}$ smaller than that of the first magnetic metal powder particles 51.

The first magnetic metal powder particles 51 having large $D_{50}$ may implement a high magnetic permeability, and the first magnetic metal powder particles 51 having large $D_{50}$ and the second magnetic metal powder particles 52 having small $D_{50}$ may be mixed with each other to improve a packing factor, whereby a magnetic permeability may be further improved and a quality (Q) factor may be improved.

$D_{50}$ of the first magnetic metal powder particles 51 may be 18 to 22 μm, and $D_{50}$ of the second magnetic metal powder particles 52 may be 2 to 4 μm.

$D_{50}$ may be measured using a particle size distribution measuring apparatus using a laser diffraction scattering method.

A particle size of the first magnetic metal powder 51 may be 11 to 53 μm, and a particle size of the second magnetic metal powder 52 may be 0.5 to 6 μm.

The magnetic body 50 may contain the mixtures of the first magnetic metal powder particles 51 having a large average particle size and the second magnetic metal powder particles 52 having an average particle size smaller than that of the first magnetic metal powder particles 51.

An insulating substrate 20 disposed in the magnetic body 50 may have the internal coil parts 42 and 44 formed on one surface and the other surface thereof, respectively, wherein the internal coil parts 42 and 44 have coil shaped patterns.

The insulating substrate 20 may be, for example, a polypropylene glycol (PPG) substrate, a ferrite substrate, a metal based soft magnetic substrate, or the like.

The insulating substrate 20 may have a through-hole formed in a central portion thereof so as to penetrate through the central portion thereof, wherein the through-hole may be filled with magnetic metal powder particles to forma core part 55. The core part 55 filled with the magnetic metal powder particles may be formed to improve an inductance.

The internal coil parts 42 and 44 may include coil patterns formed in a spiral shape, and the internal coil parts 42 and 44 formed on one surface and the other surface of the insulating substrate 20, respectively, may be electrically connected to each other through a via 46 formed in the insulating substrate 20.

The internal coil parts 42 and 44 and the via 46 may be formed of a metal having excellent electrical conductivity, for example, silver (Ag), palladium (Pd), aluminum (Al), nickel (Ni), titanium (Ti), gold (Au), copper (Cu), platinum (Pt), or an alloy thereof, etc.

One end portion of the internal coil part 42 formed on one surface of the insulating substrate 20 may be exposed to one end surface of the magnetic body 50 in the length (L) direction thereof, and one end portion of the internal coil part 44 formed on the other surface of the insulating substrate 20 may be exposed to the other end surface of the magnetic body 50 in the length (L) direction thereof.

The external electrodes 80 may be formed on both end surfaces of the magnetic body 50 in the length (L) direction thereof, respectively, so as to be connected to the internal coil parts 42 and 44 exposed to both end surfaces of the magnetic body 50 in the length (L) direction thereof, respectively.

As shown in FIG. 2, the surface protection layers 60 of end portions of the internal coil parts 42 and 44 may be polished and removed so that the end portions of the internal coil parts 42 and 44 and the external electrodes 80 are connected to each other.

The external electrode 80 may include a conductive resin layer 81 and a plating layer 82 formed on the conductive resin layer 81.

The conductive resin layer 81 may contain one or more conductive metal selected from the group consisting of copper (Cu), nickel (Ni), and silver (Ag), and a thermosetting resin.

The thermosetting resin contained in the conductive resin layer 81 and the thermosetting resin contained in the surface protection layer 60 may be the same as each other. For example, the surface protection layer 60 and the conductive resin layer 81 may contain an epoxy resin.

The magnetic body 50, the surface protection layer 60, and the conductive resin layer 81 may be formed of the same thermosetting resin, for example, the epoxy resin, such that sticking strength between the magnetic body 50 and the external electrodes 80 may be improved.

The plating layer 82 may contain one or more selected from the group consisting of nickel (Ni), copper (Cu), and tin (Sn). For example, a nickel (Ni) layer and a tin (Sn) layer may be sequentially formed in the plating layer 82.

At the time of performing a plating process of forming the plating layer 82, a plating spreading defect that the plating layer is formed on magnetic metal powder particles, which are coarse powder particles, exposed on the surface of the magnetic body 50 may occur.

However, in an exemplary embodiment of the present disclosure, the surface protection layers 60 may be formed on the surfaces of the magnetic body 50 to prevent a plating spread phenomenon due to the magnetic metal powder particles, which are the coarse powder particles.

Referring to FIGS. 2 and 3, the surface protection layers 60 according to an exemplary embodiment of the present disclosure may be formed on upper and lower surfaces of the ceramic body 50 opposing each other in the thickness (T) direction, both side surfaces of the ceramic body 50 opposing each other in the width (W) direction, and both end surfaces of the ceramic body 50 opposing each other in the length (L) direction.

Here, the surface protection layers 60 of the end portions of the internal coil parts 42 and 44 may be polished and removed so that the end portions of the internal coil parts 42 and 44 and the external electrodes 80 are connected to each other.

The surface protection layer 60 may contain a thermosetting resin, and a content of the thermosetting resin in the surface protection layer 60 may be 97 wt % or more.

The thermosetting resin may be, for example, an epoxy resin.

The epoxy resin may have excellent adhesion with a heterogeneous material, such that it may be effectively formed on magnetic metal powder particles that hardly have adsorption sites and are coarse powder particles, and may uniformly form the surface protection layer 60.

In addition, the surface protection layer 60 may be formed of the epoxy resin, which is the same thermosetting resin as the thermosetting resin contained in the magnetic body 50, such that adhesion of the surface protection layer 60 may be improved and sticking strength between the surface protection layer 60 and the conductive resin layer 81 containing the epoxy resin may be improved.

The surface protection layer 60 may further contain an insulating filler used in order to provide an insulation property.

The insulating filler may be one or more selected from the group consisting of silica ($SiO_2$), titanium dioxide ($TiO_2$), alumina, glass, and barium titanate based powder particles.

The insulating filler may have a shape such as a spherical shape, a flake shape, or the like, in order to improve density.

A content of the insulating filler contained in the surface protection layer 60 may be 100 parts by weight or less based on 100 parts by weight of the thermosetting resin.

A thickness deviation of the surface protection layer 60 may be 2 μm or less.

The surface protection layer 60 may be uniformly formed on the magnetic metal powder particles, which are the coarse powder particles, exposed on the surface of the magnetic body as well as portions in which magnetic metal powder particles, which are fine powder particles, and the thermosetting resin are positioned in the surfaces of the magnetic body 50, such that the thickness deviation of the surface protection layer 60 may be 2 μm or less.

In the case in which the thickness deviation of the surface protection layer 60 exceeds 2 μm, the magnetic metal powder particles, which are the coarse powder particles, may be exposed, such that the plating spreading phenomenon may occur.

An average thickness of the surface protection layer 60 may be 0.1 μm to 50 μm.

In the case in which an average thickness of the surface protection layer is less than 0.1 μm, the magnetic metal powder particles may be exposed, such that the plating spreading phenomenon may occur, and in the case in which an average thickness of the surface protection layer 60 exceeds 50 μm, a volume of the magnetic body may be decreased, such that an inductance may be significantly decreased.

Figure 4:
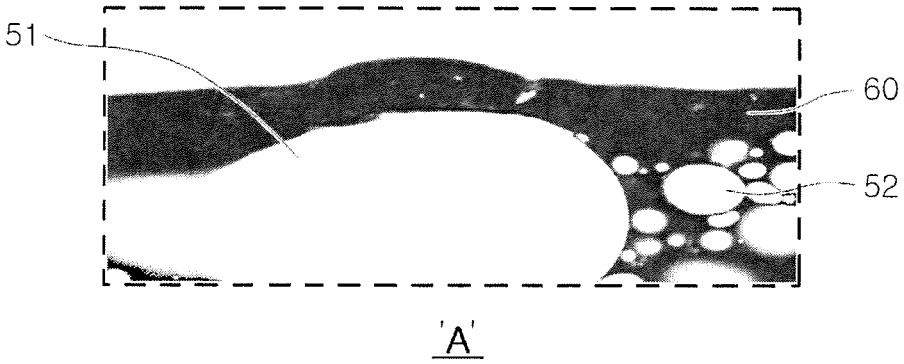
FIG. 4 is an enlarged scanning electron microscope (SEM) photograph of part 'A' of FIG. 1.

FIG. 4 is an enlarged scanning electron microscope (SEM) photograph of part 'A' of FIG. 1.

Referring to FIG. 4, the surface protection layer 60 was formed on the surface of the magnetic body 50. The surface protection layer 60 according to an exemplary embodiment of the present disclosure was uniformly formed on the first magnetic metal powder particles 51, which are the coarse powder particles. Therefore, the plating spreading defect may be effectively prevented.

Figure 5:
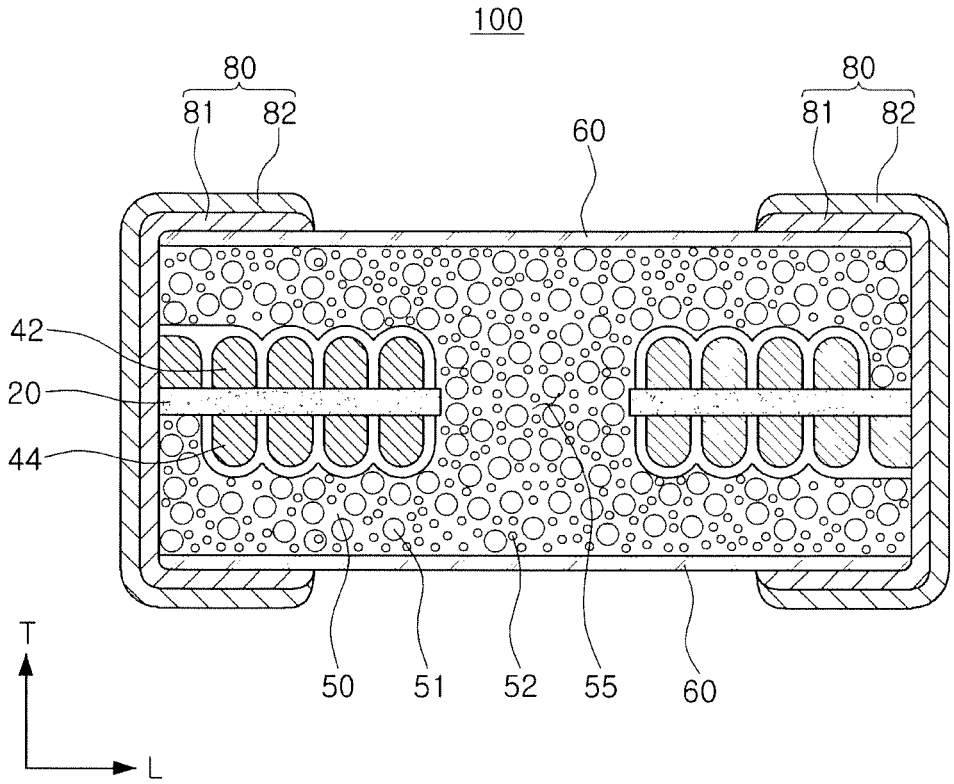
FIG. 5 is a cross-sectional view of a chip electronic component according to another exemplary embodiment of the present disclosure in an L-T direction.

FIG. 5 is a cross-sectional view of a chip electronic component according to another exemplary embodiment of the present disclosure in an LT direction.

Referring to FIG. 5, surface protection layers 60 according to another exemplary embodiment of the present disclosure may be formed on only the upper and lower surfaces of the magnetic body 50 opposing each other in the thickness (T) direction.

Although the plating spreading defect occurring due to the exposure of the magnetic metal powder particles, which are the coarse powder particles, may occur on all surfaces of the magnetic body, it may mainly occur on the upper and lower surfaces of the magnetic body.

Therefore, the surface protection layers 60 for preventing the plating spreading phenomenon may be formed on the upper and lower surfaces of the magnetic body 50, but are not necessarily limited thereto. That is, the surface protection layer 60 may be formed on at least one surface of the magnetic body 50.

The surface protection layer 60 formed on at least one surface of the magnetic body 50 may contain a thermosetting resin the same as the thermosetting resin contained in the magnetic body 50.

The surface protection layer 60 may cover the magnetic metal powder particles protruding on the surface of the magnetic body to serve as a plating spreading prevention layer.

Board Having Chip Electronic Component

Figure 6:
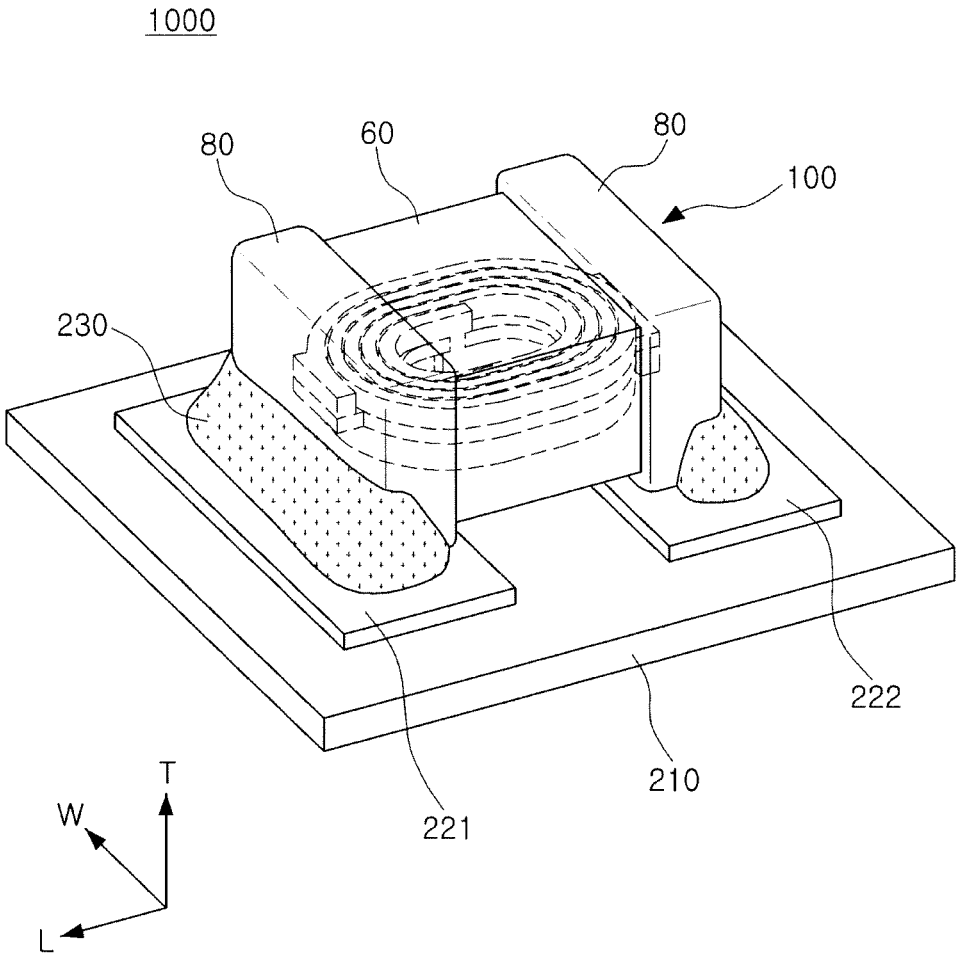
FIG. 6 is a perspective view of a board in which the chip electronic component of FIG. 1 is mounted on a printed circuit board.

FIG. 6 is a perspective view of a board in which the chip electronic component of FIG. 1 is mounted on a printed circuit board.

Referring to FIG. 6, a board 1000 having a chip electronic component 100 according to an exemplary embodiment of the present disclosure may include a printed circuit board 210 on which the chip electronic component 100 is horizontally mounted and first and second electrode pads 221 and 222 formed on an upper surface of the printed circuit board 210 so as to be spaced apart from each other.

Here, the external electrodes 80 formed on both end surfaces of the chip electronic component 100 may be electrically connected to the printed circuit board 210 by solders 230 in a state in which they are positioned on the first and second electrode pads 221 and 222, respectively, so as to contact the first and second electrode pads 221 and 222, respectively.

A description for features overlapped with those of the chip electronic component according to an exemplary embodiment of the present disclosure described above except for the above-mentioned description will be omitted.

As set forth above, according to exemplary embodiments of the present disclosure, the plating spreading phenomenon occurring on the surface of the chip electronic component at the time of forming the external electrodes may be prevented.

While exemplary embodiments have been shown and described above, it will be apparent to those skilled in the art that modifications and variations could be made without departing from the scope of the present invention as defined by the appended claims.

What is claimed is:

1. A chip electronic component comprising:

a magnetic body containing magnetic metal powder particles;

internal coil parts embedded in the magnetic body and exposed to end surfaces of the magnetic body in a length direction thereof;

external electrodes disposed on outer surfaces of the magnetic body and connected to the internal coil parts; and a surface protection layer coating on a surface of the magnetic body, wherein the surface protection layer is disposed on side surfaces of the magnetic body in a width direction thereof and upper and lower surfaces of the magnetic body in a thickness direction thereof, and the external electrodes contact at least portions of the end surfaces of the magnetic body in the length direction thereof, and are disposed on a portion of a surface of the surface protection layer in the thickness direction of the magnetic body.

2. The chip electronic component of claim 1, wherein the magnetic body further contains a thermosetting resin, and the surface protection layer contains a thermosetting resin that is the same as the thermosetting resin contained in the magnetic body.

3. The chip electronic component of claim 1, wherein the surface protection layer contains an epoxy resin.

4. The chip electronic component of claim 3, wherein a content of the epoxy resin in the surface protection layer is 97 wt % or more.

5. The chip electronic component of claim 1, wherein an average thickness of the surface protection layer is 0.1 μm to 50 μm.

6. The chip electronic component of claim 1, wherein a thickness deviation of the surface protection layer is 2 μm or less.

7. The chip electronic component of claim 2, wherein the surface protection layer further contains an insulating filler.

8. The chip electronic component of claim 1, wherein the magnetic body contains first magnetic metal powder particles and second magnetic metal powder particles having a $D_{50}$ smaller than that of the first magnetic metal powder particles, and the $D_{50}$ of the first magnetic metal powder particles is 18 μm to 22 μm, and the $D_{50}$ of the second magnetic metal powder particles is 2 μm to 4 μm.

9. The chip electronic component of claim 1, wherein the magnetic body contains first magnetic metal powder particles and second magnetic metal powder particles having an average particle size smaller than that of the first magnetic metal powder particles, and the first magnetic metal powder particles have a particle size of 11 μm to 53 μm, and the second magnetic metal powder particles have a particle size of 0.5 μm to 6 μm.

10. The chip electronic component of claim 1, wherein each of the external electrodes includes a conductive resin layer and a plating layer formed on the conductive resin layer.

11. The chip electronic component of claim 10, wherein the conductive resin layer contains a conductive metal and a thermosetting resin.

12. The chip electronic component of claim 10, wherein the plating layer contains one or more selected from the group consisting of nickel (Ni), copper (Cu), and tin (Sn).

13. A chip electronic component comprising:

a magnetic body containing magnetic metal powder particles and a thermosetting resin;

an internal coil part embedded in the magnetic body and exposed to end surfaces of the magnetic body in a length direction thereof;

a plating spreading prevention layer disposed on at least one surface of the magnetic body; and external electrodes disposed on outer surfaces of the magnetic body and connected to the internal coil part, wherein a content of a thermosetting resin in the plating spreading prevention layer is 97 wt % or more, the plating spreading prevention layer is disposed on side surfaces of the magnetic body in a width direction thereof and upper and lower surfaces of the magnetic body in a thickness direction thereof, and the external electrodes contact at least portions of the end surfaces of the magnetic body in the length direction thereof and are disposed on a portion of a surface of the surface protection layer in the thickness direction of the magnetic body.

14. The chip electronic component of claim 13, wherein the thermosetting resin contained in the plating spreading prevention layer is the same as the thermosetting resin contained in the magnetic body.

15. The chip electronic component of claim 13, wherein the thermosetting resin contained in the plating spreading prevention layer is an epoxy resin.

16. A board having a chip electronic component, comprising:

a printed circuit board on which first and second electrode pads are disposed; and the chip electronic component of claim 1 mounted on the printed circuit board.

* * * * *